US006067790A

United States Patent [19]

Choi et al.

[11] Patent Number: 6,067,790

[45] Date of Patent: May 30, 2000

[54] LEAN DIRECT WALL FUEL INJECTION METHOD AND DEVICES

[76] Inventors: Kyung J. Choi, P.O. Box 648, Glenside, Pa. 19038; Robert Tacina, 4619 Basswood Oval, Brunswick, Ohio 44212

[21] Appl. No.: 08/958,141

[22] Filed: Oct. 28, 1997

Related U.S. Application Data

[63] Continuation-in-part of application No. 08/583,629, Jan. 5, 1996, Pat. No. 5,680,765.

[51] Int. Cl.[7] ..... F02C 1/00

[52] U.S. Cl. ..... 60/39.06; 60/740; 60/748; 239/434

[58] Field of Search ..... 60/740, 39.06, 60/746, 748; 239/439, 461

[56] References Cited

U.S. PATENT DOCUMENTS

| | | | |
|---|---|---|---|
| Re. 23,149 | 9/1949 | Lubbock et al. . | |
| 5,351,489 | 10/1994 | Okamoto et al. | 60/740 |
| 5,737,921 | 4/1998 | Jones et al. | 60/740 |
| 5,899,076 | 5/1999 | Snyder et al. | 60/740 |

*Primary Examiner*—Charles G. Freay
*Attorney, Agent, or Firm*—Antonelli, Terry, Stout & Kraus, LLP

[57] ABSTRACT

A fuel combustion chamber, and a method of and a nozzle for mixing liquid fuel and air in the fuel combustion chamber in lean direct injection combustion for advanced gas turbine engines, including aircraft engines. Liquid fuel in a form of jet is injected directly into a cylindrical combustion chamber from the combustion chamber wall surface in a direction opposite to the direction of the swirling air at an angle of from about 50° to about 60° with respect to a tangential line of the cylindrical combustion chamber and at a fuel-lean condition, with a liquid droplet momentum to air momentum ratio in the range of from about 0.05 to about 0.12. Advanced gas turbines benefit from lean direct wall injection combustion. The lean direct wall injection technique of the present invention provides fast, uniform, well-stirred mixing of fuel and air. In addition, in order to further improve combustion, the fuel can be injected at a venturi located in the combustion chamber at a point adjacent the air swirler.

7 Claims, 5 Drawing Sheets

LEAN DIRECT WALL FUEL INJECTION METHOD AND DEVICES

The present application is a continuation-in-part application of Ser. No. 08/583,629, filed Jan. 5, 1996, now U.S. Pat. No. 5,680,765, which is hereby incorporated by reference.

This invention was made with Government support under contract NAG3-1421 awarded by NASA. The Government has certain rights in this invention.

BACKGROUND

The present invention relates to lean direct fuel injection combustion. More particularly, the present invention relates to a fuel combustion chamber and a method of and a nozzle for mixing of liquid fuel and air in such chamber, for example in a gas turbine engine, including an aircraft engine.

Several lean direct fuel injection (LDI) concepts have recently been considered for advanced gas turbine engine development. Although some of the concepts have shown acceptable combustion results, the geometrical configuration of the fuel-air mixers is complicated, and the combustion results have not been fully satisfactory. Development of new fuel injectors to be applied to LDI concepts is of great importance in development of advanced gas turbines. For the past several years, conventional fuel injectors, such as air-blast atomizers and pressure atomizers, have been utilized in development of high-performance gas turbine engines. However, more practical fuel injectors which are less prone to clogging are needed for future advanced aircraft engines.

Objectives of this invention are to produce rapid and uniform mixing of liquid fuel and air in combustion zones and to provide high thermal performance and low emissions in aircraft gas turbine engines. Developing advanced gas turbine engines for all speed ranges—subsonic, supersonic, and hypersonic—is one of the most urgent and important areas of aeronautical research and development. Achieving high thermal efficiency and low emissions, especially, $NO_x$, from the gas turbine engines is a major objective. As a first step to achieving this goal, increase of the inlet air compression ratio (up to 60 to 1) and fuel-lean burning have been proposed, leading to the lean direct fuel injection (LDI) concept at high pressure and temperature. In the LDI concept, combustion performance, especially emission generation, depends to a great degree upon the quality of the fuel-air mixing in the combustion zone. Problems that have been encountered include (1) providing rapid and uniform mixing of lean-fuel and rich-air in a direct injection mode, (2) improving flame stability under lean combustion conditions, (3) reducing power loss through the fuel-air mixing process, and (4) preventing clogging of injector orifices.

Since the LDI concept was introduced to aircraft engine manufacturers, some preliminary emission tests have been done by agencies of the United States government, aircraft engine companies, and academic institutions. Such tests have revealed that the LDI concept has a potential for future advanced gas turbine engines and that LDI combustion performance depends to a great degree upon the quality of fuel-air mixing.

In the LDI mode, liquid fuel is directly injected in a fuel lean ratio into a burning zone which is confined and compact. This injection method is in reality an extension of the current lean-premixed-prevaporized (LPP) concept. However, the major difference is that LPP physically separates the fuel-air mixing process from the combustion process, while LDI does not. Also, flame stabilizing is built into the fuel-air mixing process, rather than having a separate flame-holder.

SUMMARY OF THE INVENTION

The present invention is an improved method of rapid and uniform mixing of liquid fuel and air in lean direct injection (LDI) combustion with minimum power loss, and a mixing device, including an air swirler, a venturi and a pressure fuel injector, which is geometrically simple in structure and easy to manufacture.

From previous studies of LDI, important factors for successful development of advanced LDI combustors are known as follows: (1) low pressure drop through the fuel-air mixer, (2) good flame stability, (3) rapid and uniform mixing of fuel and air in the combustion zone, and (4) prevention of clogging of injector tips. As the air operating conditions become more severe (high pressure and temperature), these factors become more important.

The first two objectives can be achieved by a single global scale mixing method, i.e., using a single large air swirler which is located in the frontal plane of the combustor. For the third objective, a lean direct wall injection (LDWI) method can be utilized. A few years ago, English researchers for the first time studied direct wall injection and direct central injection in confined swirl flow under atmospheric pressure conditions. They found some improvement in $NO_x$ reduction with the wall injection of kerosene and propane fuels, but no improvement for gas oil.

Other research has been done on LDWI, including LDWI flame temperature tests, results of which are shown in FIG. 1. As can be seen there, overall emission was off the target value; however, the LDWI test results show an interesting feature, i.e., as the adiabatic flame temperature (or fuel-air equivalence ratio $\phi$) increases, the $NO_x$ emission level decreases, which is contradictory to accepted knowledge. For conventional gas turbine combustors, it is accepted that an increase of the fuel-air ratio will generate more $NO_x$. The test results were rearranged in terms of emission index and applied injector pressure and are presented in FIG. 2. It is clearly shown that the emission level decreases as the injector pressure increases at any fixed air mass flow rate.

Cold flow visualization tests of LDWI have provided very interesting observations about the LDWI concept, i.e., satisfactory liquid spray-air mixing depends to a great extent on the relative motion of the liquid spray with respect to the swirling air. In other words, better mixing of liquid spray can be achieved where the liquid droplet momentum is sufficiently large to penetrate the swirling air flow.

FIG. 3 of parent U.S. Pat. No. 5,680,765, incorporated herein by reference, shows results of water spray mixing in a confined air swirl flow, where the water spray was injected from the wall surface using a pressure injector and the conditions are equivalent to the test conditions used for the results depicted in FIG. 2, except for the air pressure and temperature. It can clearly be seen in FIG. 3 of parent U.S. Pat. No. 5,680,765 that most liquid droplets injected from the combustor wall do not fully penetrate the air stream; instead, they impact on the nearby wall surface. As the injector pressure increases, more liquid droplets stay in the air flow, resulting in better mixing. This is a reason why the increased injector pressure produced a lower $NO_x$ level as shown in FIG. 2.

Two factors have been found to be very important for the LDWI technique to be successful: (1) the ratio of the liquid droplet momentum to the swirling air momentum, and (2) the angle at which the liquid jet encounters the swirling air flow. The liquid droplet momentum should be large enough to overcome the upcoming swirling air momentum so that the liquid droplets can penetrate into the core region of the air flow, but the liquid droplet momentum should not be so large that the liquid droplets directly impact on the opposite wall of the combustor. Thus, the ratio of the liquid droplet momentum to the air momentum should be at an optimum value. It was discovered that the optimum value for the test conditions described below was in the range of from about 0.05 to about 0.12 and depends on the nozzle orifice size.

It was also found that in order to get an optimum ratio of droplet momentum to air momentum, using a liquid jet is better than using a pre-atomized liquid spray. From recent observation, it has also been found that the liquid jet should come out at a predetermined angle with respect to the tangential line of the circular tube. Injection of liquid jets at an inclined angle is essential for a successful LDWI combustor.

In addition to the above points, the inventors' further studies have determined that combustion can be substantially enhanced if the LDWI feature of the present invention is combined with a venturi. In particular, it has been found that if the wall injection fuel nozzle is located with a venturi (having side wall angles, for example, of approximately 45° relative to the longitudinal axis of the combustion chamber), substantially improved combustion can be achieved.

BRIEF DESCRIPTION OF THE DRAWINGS

These and other aspects and advantages of the present invention are more apparent from the following detailed description and claims, particularly when considered in conjunction with the accompanying drawings. In the drawings:

DETAILED DESCRIPTION OF A PREFERRED EMBODIMENT

Figure 1:
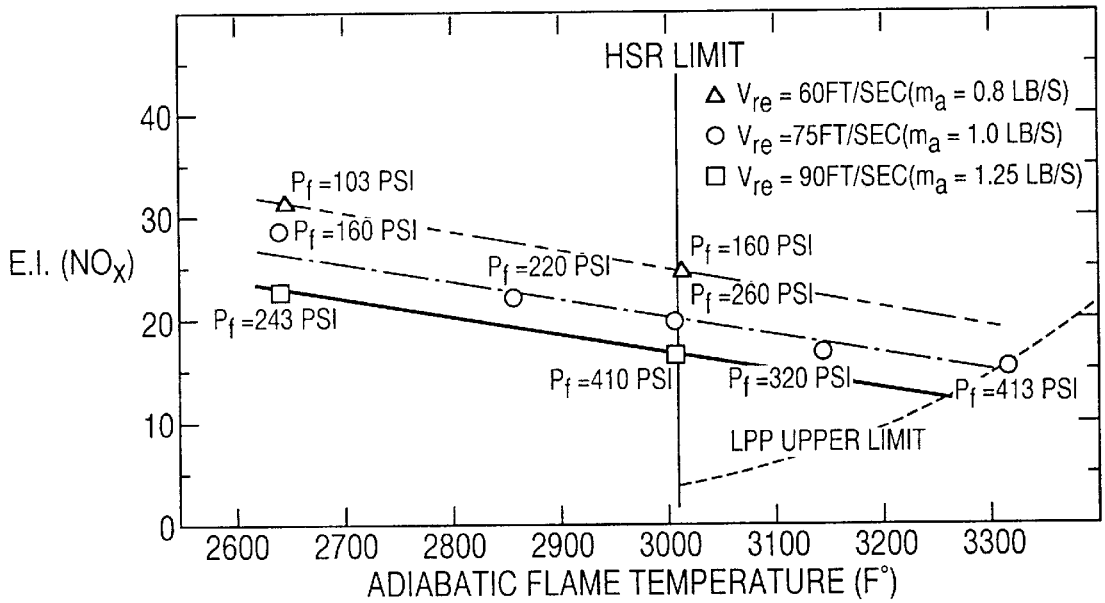
FIGS. 1 and 2 are graphs presenting test data related to the making of the present invention.
Figure 3:
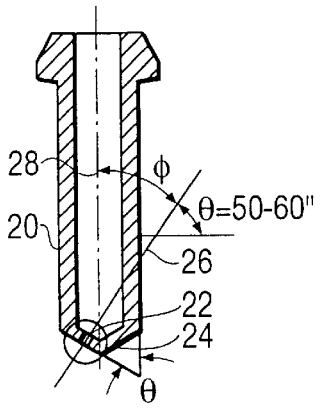
FIG. 3 is a sectional view of a pressure injector in accordance with a preferred embodiment of the present invention.
Figure 2:
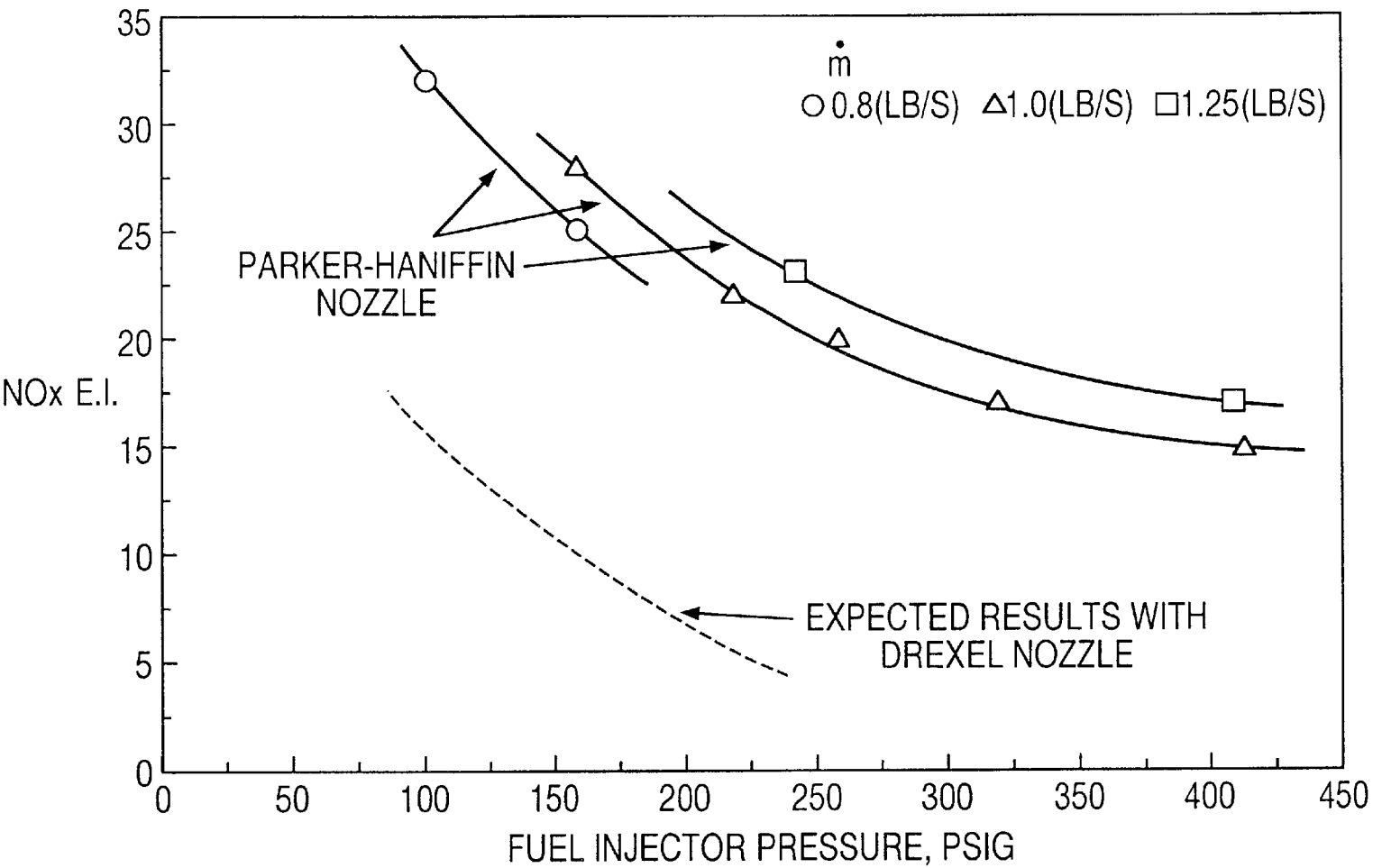

The presently preferred embodiment of the present invention is a new type of injector, in the form of a simple pressure injector nozzle with a single hole or orifice at a predetermined inclined angle, which is much simpler than conventional air-blast or pressure nozzles used in current aircraft engines. FIG. 3 depicts an injector nozzle 20 utilized in tests of the present invention. Injector nozzle 20 has a single orifice 22 at the tip 24 of the injector nozzle. The axis 26 of orifice 22 is positioned at an angle $\phi$ with respect to the longitudinal axis 28 of the injector nozzle 20, and so at an angle $\theta$ with respect to the normal to that longitudinal axis, as shown in FIG. 3. Consequently, nozzle 20 injects a single jet of liquid at such angle. Having a single orifice 22 in the injector body, without any insert inside the injector nozzle 20, makes this injector very practical for advanced aircraft engines, especially under severe operating conditions. The nozzle 20 utilized in the tests had a length of 1.452", an external diameter of 0.300", and an internal diameter of 0.125".

The present invention provides an improved method of rapid and uniform mixing of liquid fuel and air in lean direct injection (LDI) combustion with minimum power loss. The mixing method includes the following: (1) liquid fuel is directly injected into a combustor in a lean-fuel mode (so-called, Lean Direct Injection), (2) liquid fuel is injected in the form of a jet from the combustor walls (so called, Wall Injection), and (3) the liquid jet is injected at an inclined angle $\theta$, preferably in a range of from about 50° to about 60°, with respect to the tangential line of the cylindrical combustor wall, as depicted in FIG. 4B. The combined characteristics of this concept result in it being referred to as Lean Direct Wall Injection (LDWI) and result in it being very unique and completely different from both conventional aircraft fuel injection concepts and other currently developing LDI concepts.

Figure 4A:
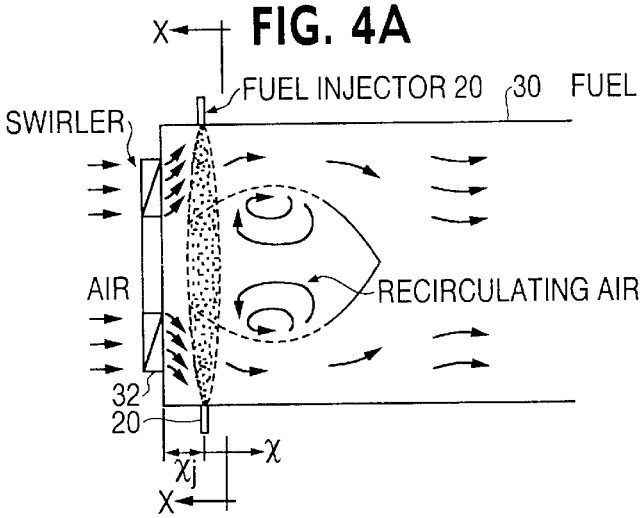
FIGS. 4A and 4B are schematic representations of lean direct wall injection in accordance with a preferred embodiment of the present invention, with FIG. 4B being taken along line X—X of FIG. 4A.
Figure 4B:
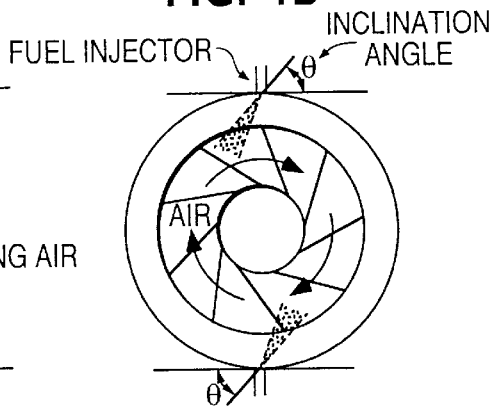
Figure 5A:
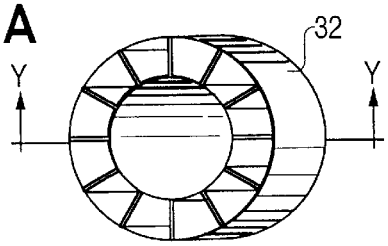
FIGS. 5A–5C are cross-sectional views of an air swirler suitable for use in a lean direct wall injection system in accordance with the present invention, with FIG. 5B being taken along line Y—Y of FIG. 5A and FIG. 5C showing the configuration of a vane of the swirler.
Figure 5B:
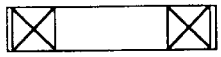
Figure 5C:
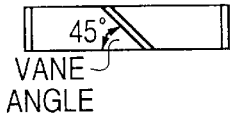

In tests of fuel-air mixing utilizing such an injector, a chamber in the form of a transparent cylindrical tube 30 as depicted in FIG. 4A, having a diameter of 3.0 inches, was used. Two injector nozzles 20 were utilized. The air was introduced through air swirler 32. To design an air swirler which creates maximum recirculating zones in both the front core and the corner regions of the circular flame tube, numerical analysis was used to obtain dimensions as shown in FIGS. 5A–5C. The vane angle of the swirler is 45°. Liquid water was injected in several different ways using different fuel injector orifice sizes.

Test results of fuel-air mixing are presented in FIGS. 7–9 of parent U.S. Pat. No. 5,680,765. FIG. 7 of the parent patent depicts central injection, and FIGS. 8 and 9 of the parent patent depict lean direct wall injection (LDWI). The results are for a constant air flow rate of 73.0 g/s at atmospheric pressure and temperature. FIG. 7 of the parent patent shows the results of liquid spray mixing at different axial locations where the liquid spray was injected in the axial direction through a center portion of the swirler. As shown in FIG. 7 of the parent patent, droplet mixing does not take place in a well-stirred fashion; instead, the droplet distribution is not uniform in the space, and it takes time for the droplets to distribute in a certain space.

FIG. 8 of the parent patent shows the results of droplet mixing at the injector tip for single liquid jet injection, where the liquid jet is injected normal to the tube axial direction, i.e., in FIG. 3 $\theta$=90°, the injection being from the tube wall at an axial distance of 1.0" from the swirler. In this wall injection case, there is no significant improvement in mixing; instead, most droplets impact upon either the opposite wall surface or the nearby wall surface, depending on the ratio of the liquid droplet momentum to the air flow momentum. As the liquid droplet momentum becomes small relative to the air momentum, the penetration of liquid droplets into the air flow decreases, and most droplets impact on the nearby wall surface.

FIG. 9 of the parent patent shows results of single liquid jet mixing where the jet was injected from the wall surface with an inclined angle $\theta$ of 60°, as depicted in FIGS. 5A and 5B. As shown in these photos, LDWI with inclined angle $\theta$=60° results in very remarkable uniform and quick mixing of droplets. The basic reason for the superiority of the LDWI technique is thought to be that the liquid jet injected from the side wall of the combustor immediately encounters the swirling airflow, resulting in very fast atomization of the liquid jet and vigorous mixing of the liquid spray with the air flow. This vigorous mixing is increased due to the liquid jet being injected at an angle $\theta$ with respect to the tangential line of the cylindrical tube 30, based on the arrangement of the axis 26 of the orifice 22 at an angle $\phi$ with respect to the longitudinal axis 28 of the injector nozzle 20. When the angle $\theta$ is between about 50° and about 60°, and thus the angle $\phi$ between about 30° and about 40°, the mixing performance is best. Also, as mentioned above, with the equipment used in this test when the ratio of the liquid jet momentum to the air flow momentum is in the range of from about 0.05 to about 0.12, the best mixing takes place. An injector in accordance with the present invention, having an orifice diameter of 0.45 mm, was used for the test.

It was observed that wall injection of a liquid jet provides an advantage over pre-atomized spray wall injection in that a liquid jet is naturally atomized by encountering the swirling air flow without the need for a complicated atomizing device. Therefore, it is advantageous to use raw liquid jets for the LDWI method. It was also observed that at the current air flow conditions the liquid flow rates for best mixing were in the range of 4.05 to 5.25 g/s. For other ranges of liquid flow rate, different orifice sizes are needed for optimum mixing performance. In application to aircraft gas turbine engines, different numbers of fuel injectors which have an optimum orifice size compatible with the actual operating conditions may be implemented to vary the fuel-air equivalence ratio. The use of this technique is very simple and reliable, yet produces well-stirred mixing of liquid fuel and air. Repeatability of this technique has been well verified by testing.

Data on droplet size distribution were approximated using a visualization technique, and it was observed that the droplet size seemed slightly larger than with conventional mixing techniques. However, it is thought that the combustion performance, especially $NO_x$ production, of advanced aircraft gas turbine engines, depends greatly on the droplet number density distribution rather than on the droplet size distribution in flame zones, because vaporization of the fuel droplets under severe operating conditions (such as critical and super-critical) will take place in a flash mode due to an extremely low surface tension of the liquid fuels. If this is correct, then smaller droplet size may produce poorer combustion performance. It is understood that recent tests have resulted in an unorthodox finding on $NO_x$ production, i.e., increased droplet size reduced $NO_x$ emissions. In addition, general combustion characteristics under such severe environmental conditions are much different from what is generally understood due to non-ideal gas effects, gas phase solubility, boundary layer stripping, and combustion instability. However, uniform mixing and uniform distribution of liquid droplets in lean direct combustion have been determined to promote lower $NO_x$ emissions.

Novel and unique features of this lean direct wall injection (LDWI) technique include: (1) low pressure drop of the air is experienced through the fuel-air mixing process, (2) liquid fuel-air mixing takes place abruptly and uniformly, i.e., in a well-stirred mixing mode, (3) a minimum number of fuel injectors are required to obtain a satisfactory degree of fuel-air mixing, and (4) the geometrical configuration is relatively simple and, therefore, practical to apply to advanced gas turbine engines. The first two features above are very important in regard to the advanced gas turbine program, because achieving high thermal performance and low $NO_x$ emission are main objectives of the program. Usually large scale mixing by using a single large swirler is preferable in view of pressure drop; however, the quality of fuel-air mixing is poor in general. The present technique satisfies both requirements, i.e., low pressure drop and good liquid droplet distribution. The third and fourth features above are also important in view of engineering applications to gas turbine engines. With regard to the third feature, although the number of injectors used in general varies depending on the characteristics of the engine being used, it is expected that, in each case, the number of injectors of the present invention will be less than the number of conventional injectors that would be required in the same engine.

Along with this novel LDWI technology, the present invention includes the simple and practical fuel injector of FIG. 3. The preferred embodiment of the fuel injector of the present invention has the following unique features: (1) a liquid jet comes out through a single orifice on the injector tip at an inclined angle θ of 50° to 60° with respect to the tangential line of the circular combustor wall, (2) the fuel injector contains only one simple orifice at the tip, without any other complicated inserts, and (3) geometrical configuration and fabrication of the injector are much simpler than presently available air-blast or pressure injectors which are used in current aircraft engines. In most existing gas turbine combustors, fuel sprays are generated through complicated inner components of fuel injectors. The major advantages of the present injector are that it is simple to use and inexpensive to fabricate. In addition, this injector avoids clogging of the injector tip, which would be a serious problem in fuel injectors used under high temperature conditions, such as encountered in advanced aircraft gas turbine engines. Further, the injector of the present invention avoids clogging problems since it can be fabricated in the simple way shown in FIG. 3, with a single large orifice at the injector tip and without any complicated inserts.

Figure 6:
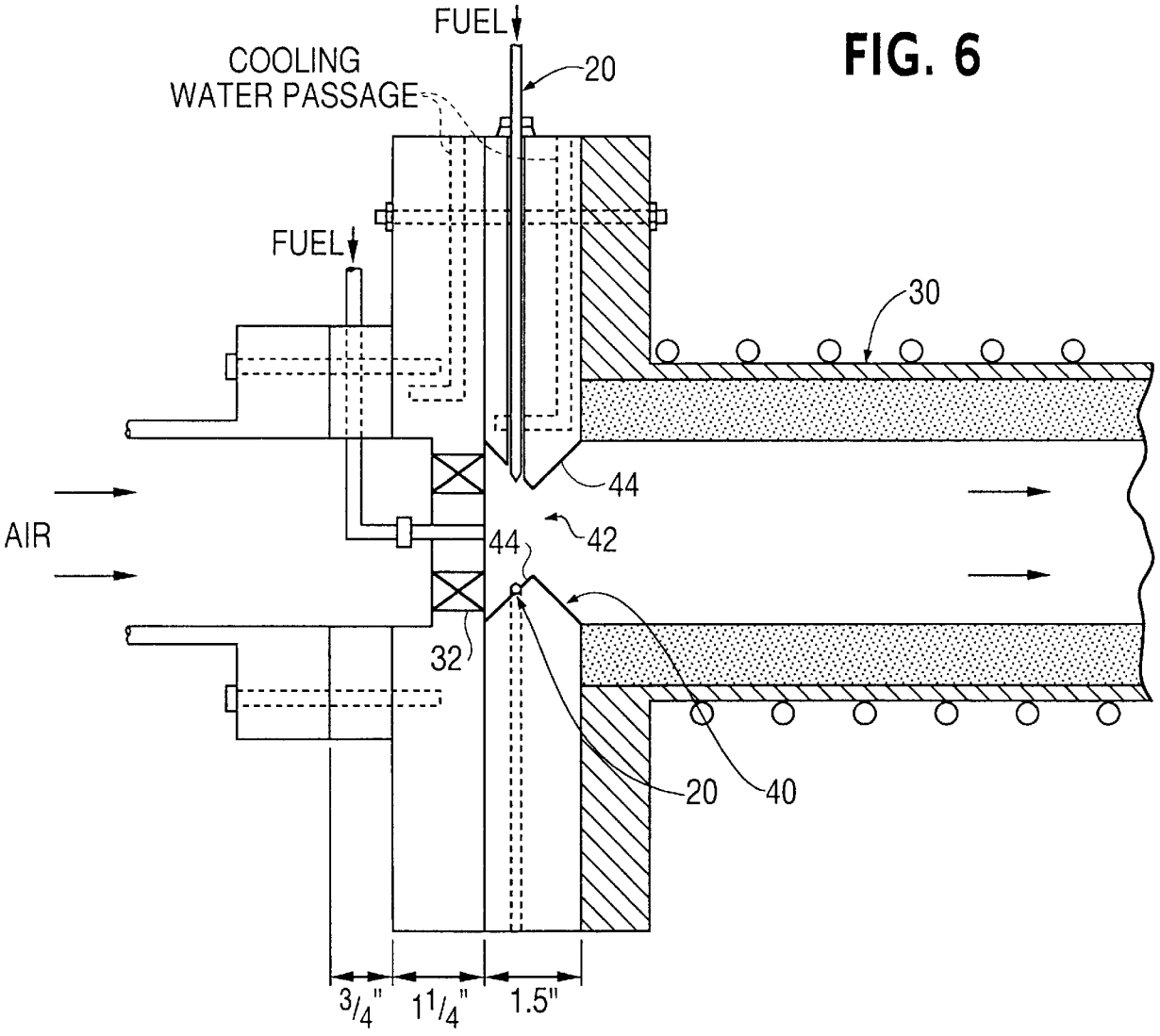
FIG. 6 shows an embodiment of the invention combining lean direct wall injection with a venturi.
Figure 7B:
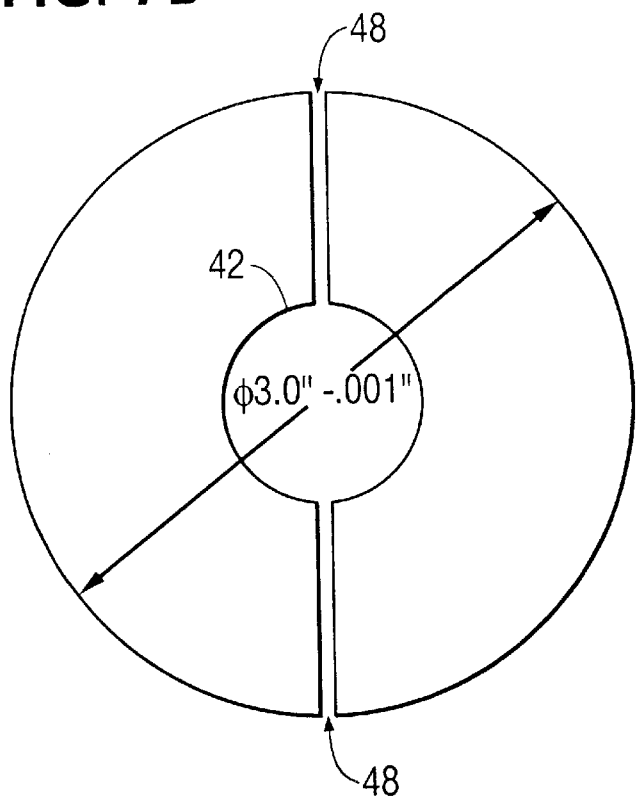
FIGS. 7A and 7B show a side view and a cross-sectional view of the venturi used in the FIG. 10 embodiment.

FIG. 6 shows an embodiment of the present invention in which the wall injection fuel nozzles 20 are led into the combustion chamber 30 through drill holes in a venturi 40 formed at the entrance to the combustion chamber, adjacent to the air swirler 32. This venturi 40 provides a constricted, substantially circular opening 42 at the entrance to the combustion chamber, as shown in FIG. 6 and FIG. 7B. In the embodiment shown in FIGS. 6, 7A and 7B, the venturi can have angular side walls 44 with an angle of approximately 45° relative to the longitudinal axis of the cylindrical combustion chamber 30, although the invention is not limited only to this specific example.

Figure 7A:
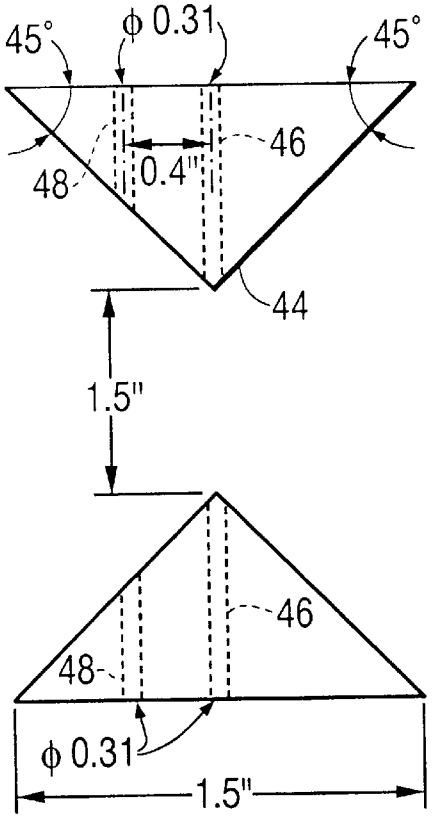

A specific embodiment of the venturi is shown in FIGS. 7A and 7B. FIG. 7A actually shows a venturi having two sets of drill holes 46 and 48 which are provided for fuel injectors. If it is desired to provide fuel injection along the side wall 44 of the venturi in the manner shown in FIG. 6, the drill holes 46 can be used. On the other hand, if it is desired to provide fuel injection right at the constricted opening 42 itself, the drill holes 48 can be used. Incidentally, it is noted that any number of drill holes desired could be used to locate fuel injection nozzles at a desired number of locations around the venturi.

FIG. 7B shows a cross-sectional view of a venturi (through drill holes 48) which illustrates the substantially circular shape that can be used for the constricted opening 42 (noting again, for example, that this is solely for purposes of example, and not for purposes of limiting the invention only to this embodiment). As such, this substantially circular constricted opening 42 can be effectively concentric with the substantially circular cross-section of the cylindrical chamber itself. In the example shown, the outer diameter of the venturi (corresponding to the inner diameter of the cylindrical combustion chamber) can be three inches, while the diameter of the substantially circular constricted opening can be 1½ inches, although these diameters are provided solely for purposes of example.

In simulations conducted with the venturi shown in the embodiment of FIGS. 6, 7A and 7B, it was determined that the venturi serves to substantially enhance the results of the combustion. In particular, the inventors determined that the temperature distribution through the combustion chamber was substantially improved with the venturi, leading to much better combustion. Accordingly, the combination of the LDWI of the present invention and the venturi can provide substantially improved results compared with prior art devices.

Although the invention has been described with respect to a preferred embodiment, it is to be understood that modifications of this embodiment could be made without departing from the scope of the invention. For example, the injector itself could be modified in terms of angles, orifice size and shape, geometrical configuration and arrangement along the wall while still accomplishing the goals of the present invention.

What is claimed is:

1. A liquid fuel combustion apparatus, comprising:

a hollow cylindrical combustion chamber member having a first end and a cylindrical wall;

an air swirler attached to said combustion chamber member first end and coaxial with said combustion chamber member, for introducing swirling air in a predetermined direction into said combustion chamber member, said air swirler including a hollow annular swirler body with a plurality of swirler vanes therein, each vane being angled with respect to the axis of said annular swirler body;

a venturi located to project into said combustion chamber at said first end thereof, adjacent to said air swirler, wherein said venturi includes an opening in which a fuel injection nozzle is located including an elongated, hollow cylindrical nozzle body member having a first end with an inlet opening for flow of liquid fuel into said nozzle body member, and a second end with a single outlet opening positioned to inject the liquid fuel as a jet through said nozzle body member outlet opening into said combustion chamber at an angle of from about 50° to about 60° with respect to a tangential line of the combustion chamber member cylindrical wall in a direction opposite to the predetermined direction of the swirling air, to cause the liquid fuel and the air to mix abruptly and uniformly in a well stirred mixing mode.

2. A liquid fuel combustion apparatus as claimed in claim 1, wherein said air swirler vanes are angled at an angle of about 45° with respect to the axis of said annular swirler body.

3. A liquid fuel combustion apparatus as claimed in claim 1, wherein said venturi forms a constricted substantially circular opening concentric with said cylindrical wall, at said first end of said cylindrical combustion chamber.

4. A liquid fuel combustion apparatus as claimed in claim 3, wherein said venturi has side walls extending between the cylindrical wall and the constricted substantially circular opening, said side walls having an angle of approximately 45° relative to a longitudinal axis of the cylindrical combustion chamber.

5. A liquid fuel combustion apparatus as claimed in claim 1, wherein said venturi has a second opening in which a second fuel injection nozzle is located including a second elongated, hollow cylindrical nozzle body member having a second nozzle body member first end with an inlet opening for flow of liquid fuel into said second nozzle body member, and a second nozzle body member second end with a single outlet opening positioned to inject the liquid fuel as a jet through said second nozzle body member outlet opening and said combustion chamber member second fuel inlet orifice at an angle of from about 50° to about 60° with respect to a second tangential line of the combustion chamber member cylindrical wall, to cause the liquid fuel and the air to mix abruptly and uniformly in a well stirred mixing mode.

6. A method of injecting liquid fuel into a hollow cylindrical combustion chamber having a first end and a cylindrical wall, said method comprising the steps of:

(a) introducing swirling air in a predetermined direction through said combustion chamber first end into said combustion chamber, wherein said swirling air is passed through a venturi located at said first end of the combustion chamber as it is introduced into said combustion chamber;

(b) injecting liquid fuel as a jet through said cylindrical wall and into said hollow cylindrical combustion chamber in a direction opposite to the direction of the swirling air at an angle of from about 50° to about 60° with respect to a tangential line of the combustion chamber cylindrical wall thereby forming liquid droplets; and (c) maintaining the ratio of the liquid droplet momentum to air momentum in the range of from about 0.05 to about 0.12, whereby the liquid fuel and the air mix abruptly and uniformly in a well stirred mixing mode.

7. A liquid fuel combustion apparatus comprising:

a hollow cylindrical combustion chamber member having a first end and a cylindrical wall, with a fuel inlet orifice through said cylindrical wall;

an air swirler attached to said combustion chamber member first end and coaxial with said combustion chamber member, for introducing swirling air in a predetermined direction into said combustion chamber member, said air swirler including a hollow annular swirler body with a plurality of swirler vanes therein, each vane being angled with respect to the axis of said annular swirler body; and a venturi located to project into said combustion chamber member at said first end thereof, adjacent to said air swirler, wherein said venturi includes one or more openings in which one or more fuel injection nozzles are located, each including an elongated, hollow cylindrical nozzle body member having a first end with an inlet opening for flow of liquid fuel into said nozzle body member, and a second end with a single outlet opening positioned to inject the liquid fuel as a jet through said nozzle body member outlet opening and said combustion chamber member fuel inlet orifice in a direction opposite to the direction of the swirling air at an angle of from about 50° to about 60° with respect to a tangential line of the combustion chamber member cylindrical wall, to cause the liquid fuel and the air to mix abruptly and uniformly in a well stirred mixing mode to increase combustion efficiency.

* * * * *